US007309824B2

(12) United States Patent
LeBlanc

(10) Patent No.: US 7,309,824 B2
(45) Date of Patent: Dec. 18, 2007

(54) MACHINE FOR CHANGING THE KEY OF A STRINGED MUSICAL INSTRUMENT

(75) Inventor: Curtis Robert LeBlanc, 153 Chisholm Trail, Thibodaux, LA (US) 70301

(73) Assignee: Curtis Robert LeBlanc, Thibodaux, LA (US)

( * ) Notice: Subject to any disclaimer, the term of this patent is extended or adjusted under 35 U.S.C. 154(b) by 0 days.

(21) Appl. No.: 11/359,082

(22) Filed: Feb. 21, 2006

(65) Prior Publication Data

US 2006/0236841 A1 Oct. 26, 2006

Related U.S. Application Data

(60) Provisional application No. 60/655,215, filed on Feb. 22, 2005.

(51) Int. Cl.
*G10D 3/04* (2006.01)

(52) U.S. Cl. ..... 84/298

(58) Field of Classification Search ..... 84/312 R, 84/200, 202, 204, 206, 207
See application file for complete search history.

(56) References Cited

U.S. PATENT DOCUMENTS 4,453,443 A * 6/1984 Smith ..... 84/298
5,198,601 A * 3/1993 McCabe ..... 84/298

* cited by examiner

*Primary Examiner*—Kimberly Lockett

(57) ABSTRACT

The present invention relates to a machine for changing the key of a stringed musical instrument. The machine includes a mounting base, a structure for securing the mounting base to the stringed musical instrument, a housing body to provide a space to accommodate tuning mechanisms, a plurality of control rod assemblies to selectively adjustment for several tunings, a plurality of tuner switch rod assemblies to provide mechanisms to switch between tunings, a set of tuning mechanisms on each control rod assembly for fine adjustment of tuning while in use, a plurality of bridge rollers to adjust height and intonation of strings, a top plate with a plurality of tuner switch screw slots that provide access to the tuner switch rod assemblies, which provide a choice from different tunings, and a lever body to relieve string tension while changing tunings.

21 Claims, 13 Drawing Sheets

Fig. 4a
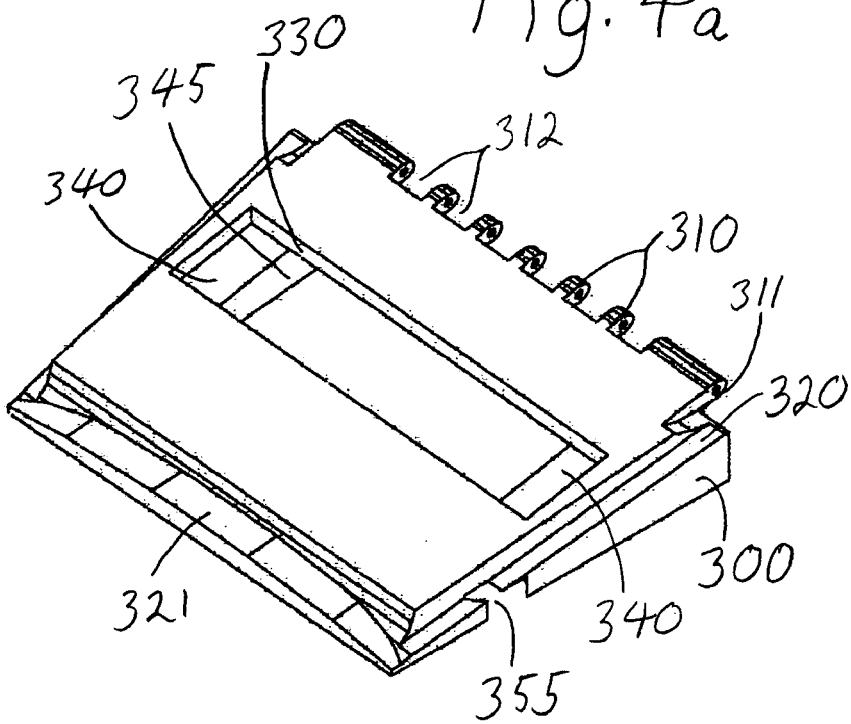
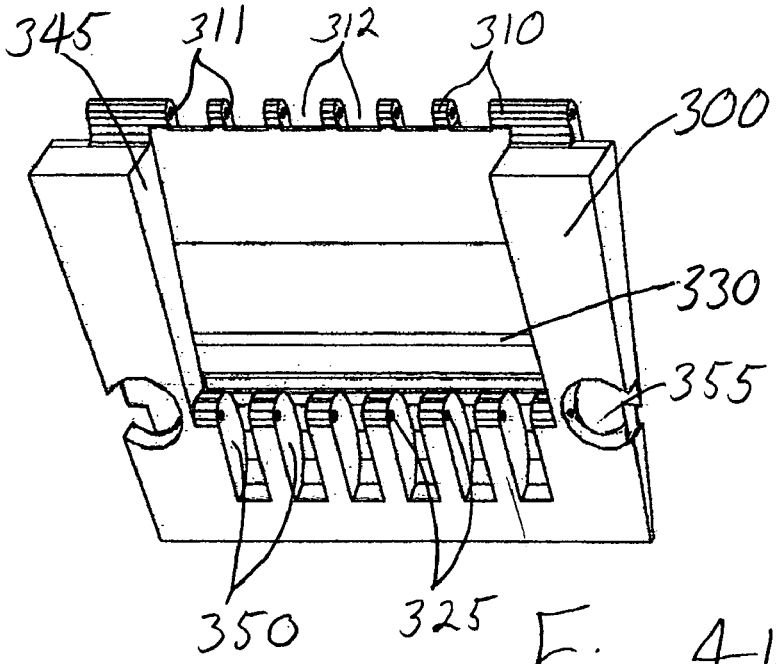
Fig. 4b

Fig. 5a
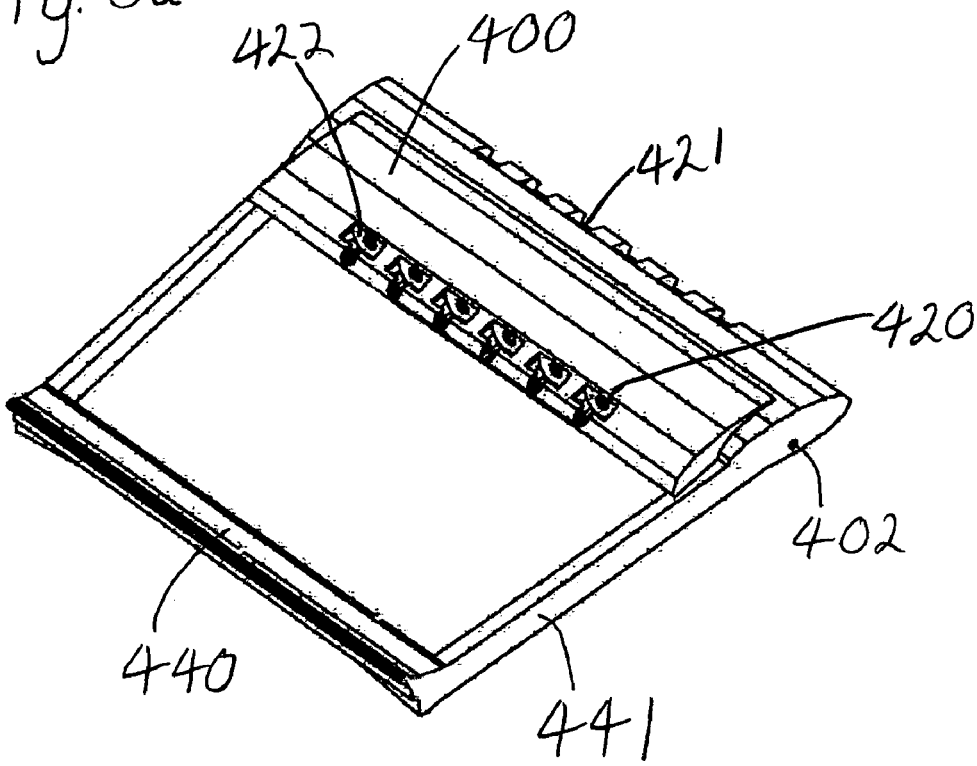
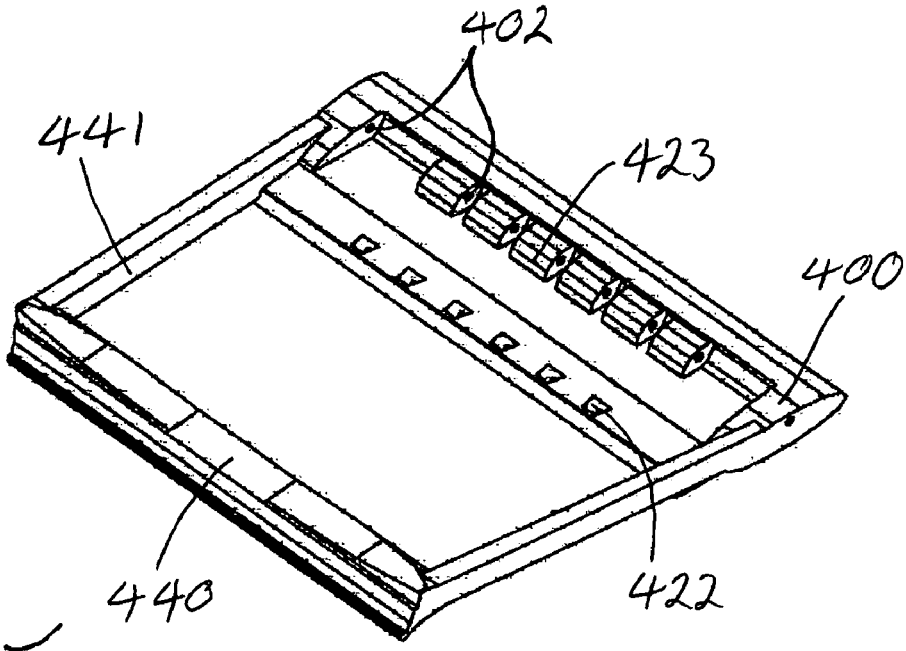
Fig. 5b

Fig. 7a
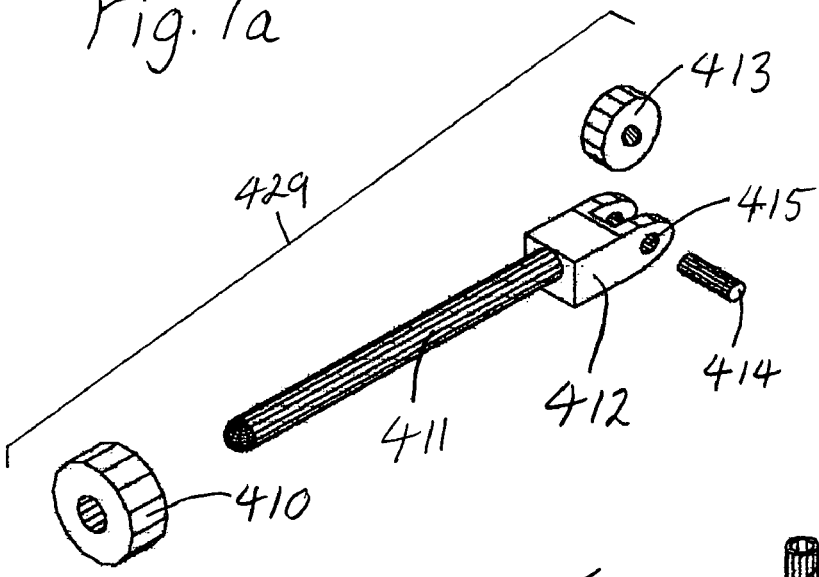
Fig. 7c
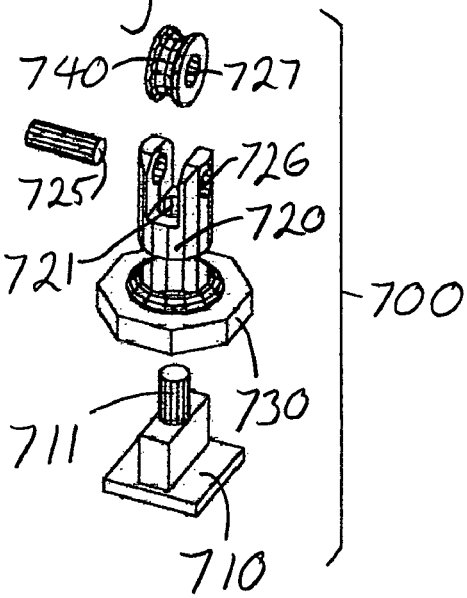
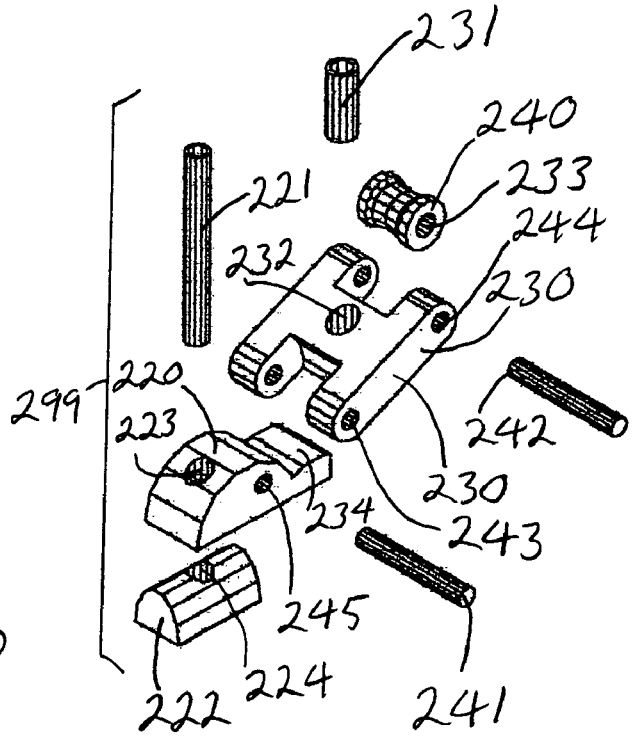
Fig. 7b

MACHINE FOR CHANGING THE KEY OF A STRINGED MUSICAL INSTRUMENT

CROSS REFERENCE TO RELATED APPLICATIONS

This application is based on provisional application Ser. No. 60/655,215, filed on Feb. 22, 2005.

STATEMENT REGARDING FEDERALLY SPONSORED RESEARCH OR DEVELOPMENT

Not Applicable

DESCRIPTION OF ATTACHED APPENDIX

Not Applicable

BACKGROUND OF THE INVENTION

The present invention relates generally to tuning devices for stringed musical instruments, and more particularly, to a machine for changing the key of a stringed musical instrument.

Guitars are a popular form of musical expression all over the world. A majority of guitars utilize a single tuning configuration. This allows only one setting of tuned strings per instrument. Before playing the instrument, this tuning must be provided for each string in the desired key via string manipulation.

Many artists who perform with stringed instruments, such as guitars, wish to be able to change the general key in which the instrument is tuned. This change is desired to change the overall sound that the instrument can create. Artistic expression of the artist is, therefore, limited, if the musician cannot change the tuning configuration of the strings of a guitar quickly and efficiently.

Manually changing the tension of guitar strings can be a time-consuming process. It takes time to tune all the strings to the general key of the instrument. During a concert performance, performing this task between songs is difficult if not impossible to accomplish and during composing it is counterproductive to the writing process.

During a song, manually changing the tuning of a guitar with traditional tuning means is all but impossible, especially given the sophistication of live audiences, who can sense an out of tune string on a guitar.

U.S. Pat. No. 5,438,902, issued in the name of Baker, discloses a multi-tuner for stringed musical instruments wherein an adjustable cam mechanism allows the user to select different predefined string tensions for all of the strings by rotating the cam. The cam disclosed in the '902 patent to Baker limits the number of predefined tuning sets.

U.S. Pat. No. 3,479,917, issued in the name of Zitnik, Jr. et al., discloses a multiple lever tone changer for guitars, wherein individual levers are provided to allow the musician to create a vibrato effect, either on a single string or on the entire set of strings. The individual levers do not act together to change the entire key in which the instrument can be tuned.

Two patents disclose bridge assemblies for guitars that incorporate adjustable intonation means: U.S. Pat. No. 4,867,031, issued in the name of Fender and U.S. Pat. No. 5,602,353, issued in the name of Juszkiewicz et al.

Several patents disclose bridge assemblies for guitars that incorporate adjustment means for changing individual string tension, intonation, and saddle height: U.S. Pat. No. 4,625,613, issued in the name of Steinberger, U.S. Pat. No. 4,688,461, issued in the name of Stroh, U.S. Pat. No. 5,265,512, issued in the name of Kubicki et al., and U.S. Pat. No. 5,539,143, issued in the name of Rose.

Several patents disclose automatic string tension adjusting means for stringed instruments that maintains a predefined tone for each string by electronically monitoring the string tone and adjusting it via an electric motor. These include U.S. Pat. No. 2,624,027, issued in the name of Clark, U.S. Pat. No. 4,928,563, issued in the name of Murata et al., and U.S. Pat. No. 5,095,797, issued in the name of Zacaroli. Such devices, however, are expensive and complicated and as such are prone to electronic component failure with repeated use.

A search of the prior art did not disclose any patents that read directly on the claims of the instant invention.

U.S. Pat. No. 5,542,330, issued in the name of Borisoff, discloses a multi-tuner for stringed musical instruments wherein an adjustable lever mechanism allows the user to select, on a per string basis, from three different predefined string tensions.

First, the '330 device is designed to use the mounting mechanism on a flat-mount guitar. Since the '330 device is designed to function mainly on a flat-mount guitar configuration, it is not designed to be used with the vast majority of stringed instruments, such as Gibson Les Paul™ Guitars. Second, the '330 device connects to the guitar face by screwing a flat plate directly to the guitar face which may cause irreversible damage to the instrument. The '330 device does not secure to pre-existing mounting hardware. Further, the device described in the '330 patent does not account for the change in string tension and does not account for the effect that it has on the neck of the stringed musical instrument.

While the general concept of the per string, multi-position tuning feature is incorporated into this invention, other elements are different enough to be distinguished over the inventors' own prior art. U.S. Pat. No. 6,184,450, issued in the name of LeBlanc, only uses one extra predefined tuning adjustment per string and is limited in the range of multi tuning capabilities. Consequently, a need has therefore been felt for an improved but less complex mechanism that provides multiple per string multi-position tuning capabilities for stringed musical instruments.

BRIEF SUMMARY OF THE INVENTION

The primary object of the invention is to provide a method and apparatus for the player of the stringed musical instrument to switch from one pre-selected tuning to a number of other pre-selected tunings.

Another object of the invention is to provide a method and apparatus for the player of the stringed musical instrument to adjust finely amounts of string tension so the player can keep the instrument in tune.

Another object of the invention is to provide a structure to more securely affix the apparatus to the instrument and improve its tonal quality and control.

A further object of the invention is to provide an apparatus for a stringed musical instrument that is aesthetically pleasing.

Yet another object of the invention is to provide an apparatus for a stringed musical instrument that is easy to install and setup.

Still another object of the invention is to provide an apparatus for a stringed musical instrument that is easy to remove without damaging the instrument.

Other objects and advantages of the present invention will become apparent from the following description, taken in connection with the accompanying drawings, wherein, by way of illustration and example, an embodiment of the present invention is disclosed.

In accordance with a preferred embodiment of the present invention, there is disclosed a machine for changing the key of a stringed musical instrument of simplified design that can be used with any existing guitar configurations.

Therefore, it is an object of the present invention to more securely affix the invention to a stringed musical instrument improving its tonal quality and control by adding weight and rigidity, while improving the acoustic characteristics of the instrument.

Another object of the present invention is to provide an apparatus for a stringed musical instrument that is easy to install, setup, and remove without damaging the instrument, while leaving the instrument aesthetically pleasing and comfortable to the musician while playing the musical instrument.

A further object of the present invention is to provide a method and apparatus for the player of the stringed musical instrument to switch instantaneously from one pre-selected tuning to a number of other pre-selected tunings already installed on the instrument.

Yet, a further object of the present invention is to provide a method and apparatus for the player of the stringed musical instrument to be capable of adjusting the height of the instrument's strings, that permits variations in intonation, and allows the strings to roll or slide over the bridge roller while the instrument is in use.

Still another object of the present invention is to provide a method and apparatus for the player of the stringed musical instrument ability to adjust finely amounts of string tension so the player can keep the instrument in tune.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

FIGS. 4*a* and 4*b* show perspective views of a housing body according to the invention.

FIGS. 5*a* and 5*b* show perspective views of a lever body according to the invention.

FIGS. 7*a*, 7*b*, 7*c*, and 7*d* show perspective views of a tuner extension mechanism, a bridge assembly, an alternate bridge assembly, and a control rod assembly, respectively, according to the invention.

DETAILED DESCRIPTION OF THE INVENTION

Detailed description of the invention is provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1A:
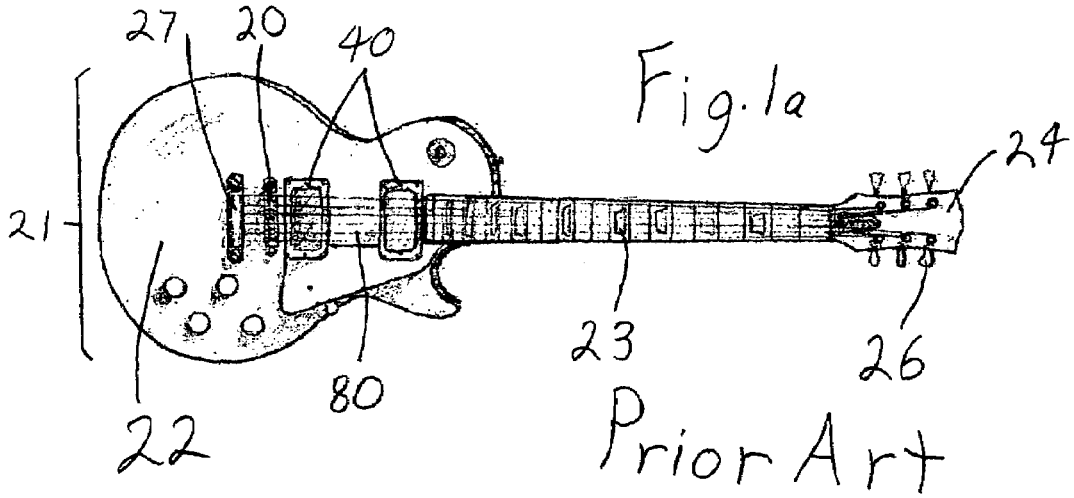
Fig. 1a Prior Art
FIG. 1*a* (prior art) shows a perspective view of an electric guitar.
Figure 1B:
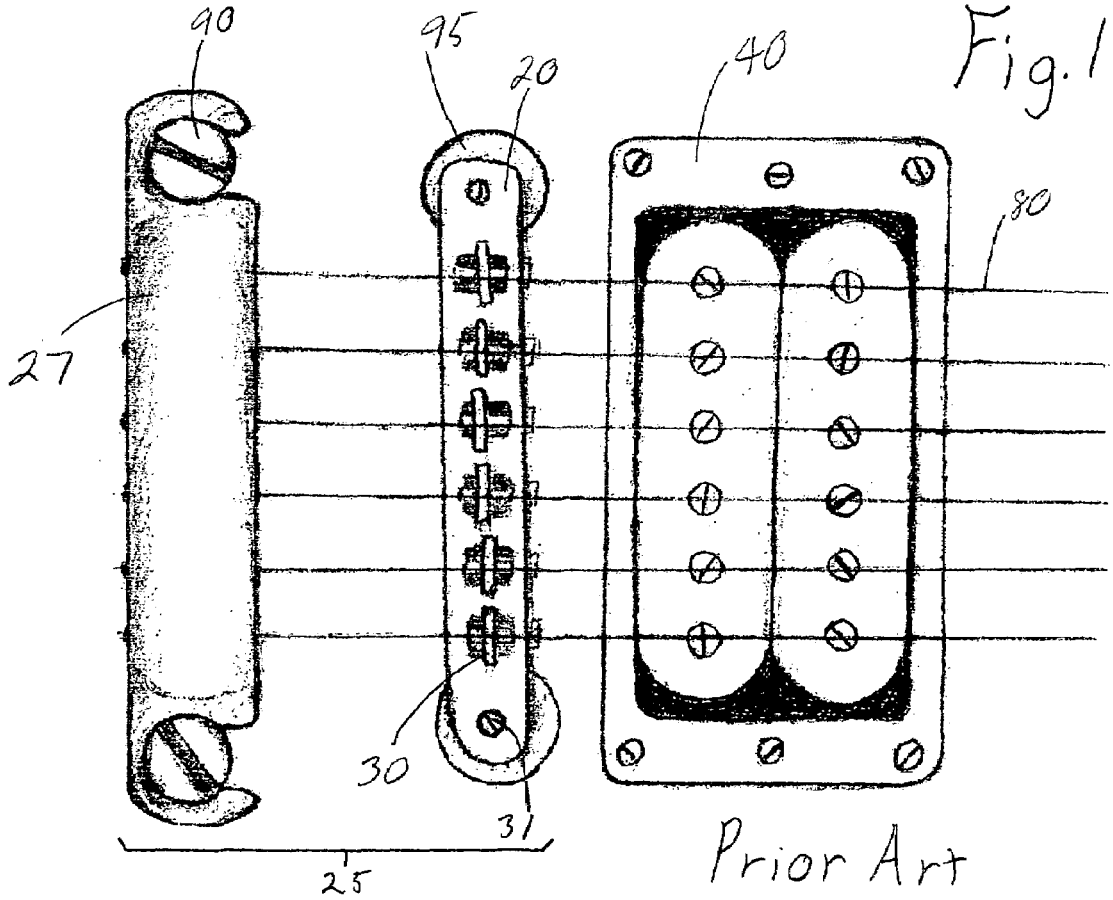
Fig. 1b Prior Art
FIG. 1*b* (prior art) shows a view of the bridge area of the guitar shown in FIG. 1*a*.

FIGS. 1*a* and 1*b* show prior art. FIG. 1*a* shows a perspective view of a stringed musical instrument 21 of the electric configuration, illustrating a guitar body 22, a guitar neck 23 extending from the guitar body 22, and a head stock 24 disposed at the end of the guitar neck 23. The head stock 24 has a plurality of tuning pegs 26 that can selectively increase or decrease the tension placed on a plurality of strings 80. FIG. 1*a* further illustrates the placement of a stop tailpiece 27 and a bridge system 20. As is commonly known in the prior art, one end of each string 80 is extended through the stop tailpiece 27 of the stringed musical instrument 21 and over bridge system 20, over a plurality of electric guitar pickups 40, and is wound around an associated tuning peg 26. Each of the plurality of strings 80 is pulled tight across the guitar neck 23 and guitar body 22 by continued rotation of the tuning pegs 26 until the desired tones are achieved.

FIG. 1*b* shows a plan view of the bridge area 25 on the stringed musical instrument 21, illustrating a more detailed view of the stop tailpiece 27 and the bridge system 20. FIG. 1*b* also stop tail piece bolts 90 located on each side of stop tailpiece 27. Stop tailpiece bolts 90 are used to secure the stop tailpiece 27 to the guitar body 22 (as shown in FIG. 1*a*). Stop tailpiece 27 holds one end of each of the plurality guitar strings 80. A plurality of bridge support nuts 95 is placed under each side of the bridge system 20 for adjusting the height of bridge system 20. FIG. 1*b* further shows a plurality of string saddles 30 positioned transversely to and below the plural of strings 80 also attached to the bridge system 20 for the purpose of intonation. Also a plurality of bridge posts 31 that are generally elongated cylindrical columns with external threads, that is, screws, facilitate the adjustment of the height of bridge system 20. FIG. 1*b* further shows electric guitar pickups 40 positioned just in front of bridge system 20.

Figure 2:
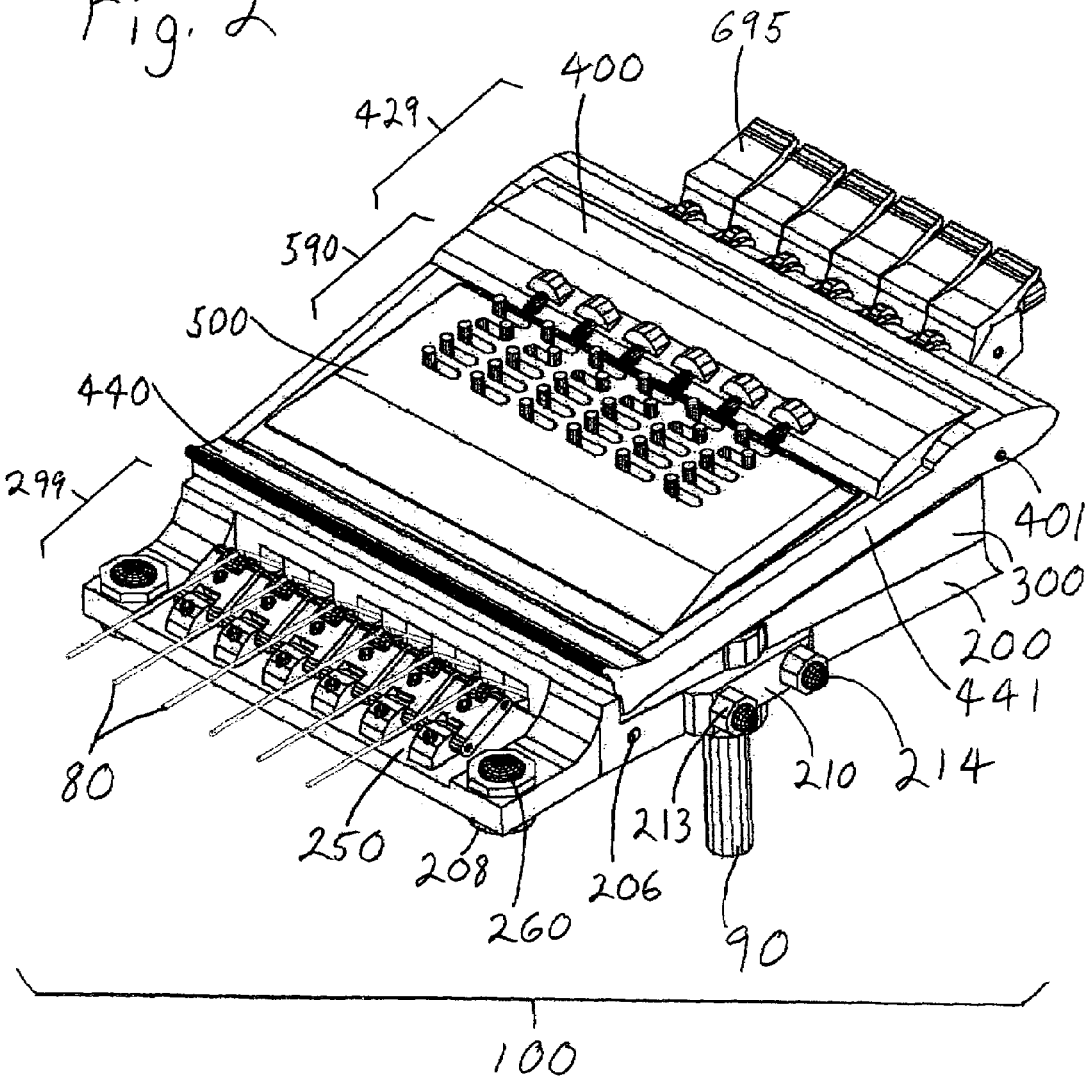
FIG. 2 shows a perspective view of the preferred embodiment of a machine for changing the key of a stringed musical instrument.

FIG. 2, shows a perspective view of the preferred embodiment of a machine for changing the key of a stringed musical instrument comprising a preferably quadrilateral-shaped mounting base 200 with a plurality of rectangular stop tail piece clamps 210 that retain the existing stop tail piece bolts 90 by way of a plurality of stop tail piece clamp nuts 213 and bolts 214 that provide a means for securing the invention to stringed musical instrument 21, thereby making the invention more rigid. In addition, a plurality of bridge nuts 260 help hold the invention in place. Moreover, a plurality of support pillars 208 extends downward from the bottom of the mounting base 200 on opposite sides of the elongated centerline of the stringed musical instrument 21. Also shown is a rectangular bridge cut-out section 250 in the front section of the mounting base 200. A plurality of bridge assemblies 299 is placed on the mounting base 200 at cut-out section 250. A housing body 300 is secured on top of the mounting base 200. Lever body 400 is located on housing body 300 and is pivotable at one end of the housing body 300 by means of lever handle 440, which is attached to the main pivot pin 401, located at the rear of said housing body 300, through lever arms 441. Said lever body 400 also has a plurality of tuner extensions 429 that align with the elongated centerline of the stringed musical instrument 21 and that are located in the rear of said lever body 400, to adjust the tightest pre-set tuning. Further control rod assemblies 695 extend through the housing body 300 and mounting base 200 toward a bottom string roller pin 206 along the elongated centerline of the stringed musical instrument 21, and are used to manipulate the string tension. FIG. 2 also shows a plurality of tuner switch rod assemblies 590 that provide a means for switching between preset tunings.

Figure 3A:
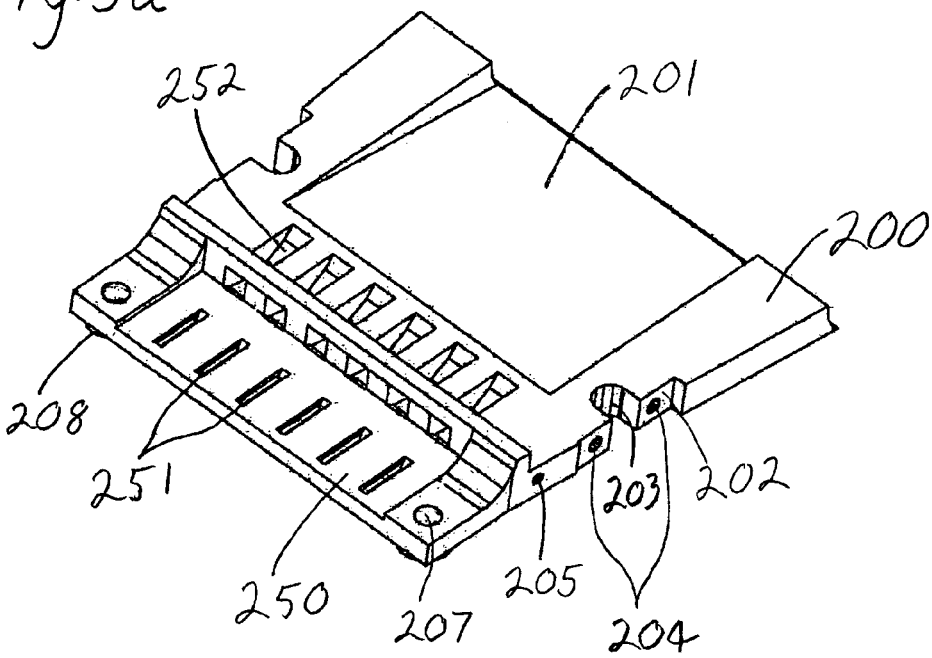
FIGS. 3*a* and 3*b* show perspective views of a mounting base according to the invention.

FIG. 3*a* shows a perspective view of the mounting base 200 showing the bridge cut-out section 250 for the bridge assemblies 299 or the alternate bridge assemblies 700 (shown in FIGS. 7*b* and 7*c*). A plurality of equally spaced rectangular slots 251 in the mounting base 200, under the bridge cut-out section 250 corresponding to the number of strings 80 on the stringed musical instrument 21 provide a means for securing the bridge assemblies 299 to said mounting base 200 while allowing for adjustment of intonation and height. A plurality of spaced-apart bottom string roller cavities 252, each corresponding to an associated bridge assembly 299, are disposed adjacent to and extend in a downward arc from the middle back section of the bridge cut-out section 250, thereby allowing the strings 80 to pass from the control rod body 600 to the bridge assembly 299 or the alternate bridge assembly 700 (shown in FIGS. 9*a* and 9*b*). An aperture 205 is transversely placed through each bottom string roller cavity 252 for a bottom string roller pin 206 to penetrate (shown in FIG. 3*b*). Each of the stop tail piece bolts 90 (as shown in FIG. 2) fits into a plurality of semicircular indentations 203. A universal flat mounting surface 202 has a plurality of apertures 204 transversely through the mounting base 200, on each side of each semicircular indentation 203 to provide a means for the stop tail piece clamps 210 (shown in FIG. 2), to be securely affixed to the mounting base 200. A cut-out 201 allows for disposition thereon of a control rod assembly 695. A plurality of support pillars 208 extends downward from the bottom of the mounting base 200, positioned so that a plurality of vertical apertures 207, extends through both the outer front sections of the mounting base 200 and each support pillar 208 on opposite sides of the elongated centerline of the stringed musical instrument 21, thereby providing a solid footprint for mounting the invention to the stringed musical instrument 21. Placing the mounting base 200 over bridge post 31 (shown in FIG. 1*b*) and screwing the bridge nut 260 on to said bridge post 31 further secures the invention to the stringed musical instrument 21. Further, a plurality of threaded apertures, located on opposite corners and through the mid and back outer sections of the mounting base 200, provide a means for securing the housing body 300 to the mounting base 200 (shown in FIG. 10*a*).

Figure 3B:
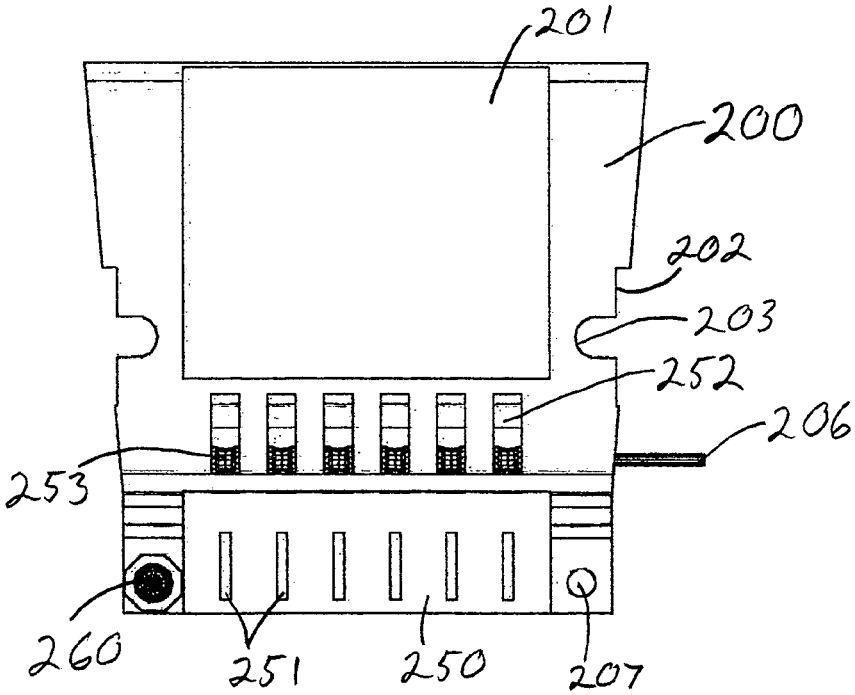

In accordance with the present invention, FIG. 3*b* shows a plan view of the mounting base 200, a plurality of bottom string rollers 253 counter sunk into the bottom string roller cavities 252 so that the bottom string roller pin 206 can retain the bottom string rollers 253 within the mounting base 200 while also allowing the strings 80 to slide or roll over the bottom string rollers 253 while the strings are in use. A plurality of semicircular indentations 203 in a universal flat mounting surface 202 on each side of the mounting base 200, accept the stop tail piece bolts 90 so the stop tail piece clamps 210 can firmly grasp the stop tail piece bolts 90 thus holding the invention tightly affixed to the stringed musical instrument 21. FIG. 3*b* also shows the rectangular bridge cut-out 250 and a plurality of spaced-apart rectangular slots 251 for the bridge assemblies 299 or the alternate bridge assemblies 700 (shown in FIGS. 7*b* and 7*c*), and also shows the cut-out 201 for a lower control rod, located in the center back portion of the mounting base 200. Further, FIG. 3*b* shows a bridge nut 260, of which there are customarily two that are located on opposite sides of the bridge area 25 and over the plurality of vertical apertures 207 in the mounting base 200.

Figure 9A:
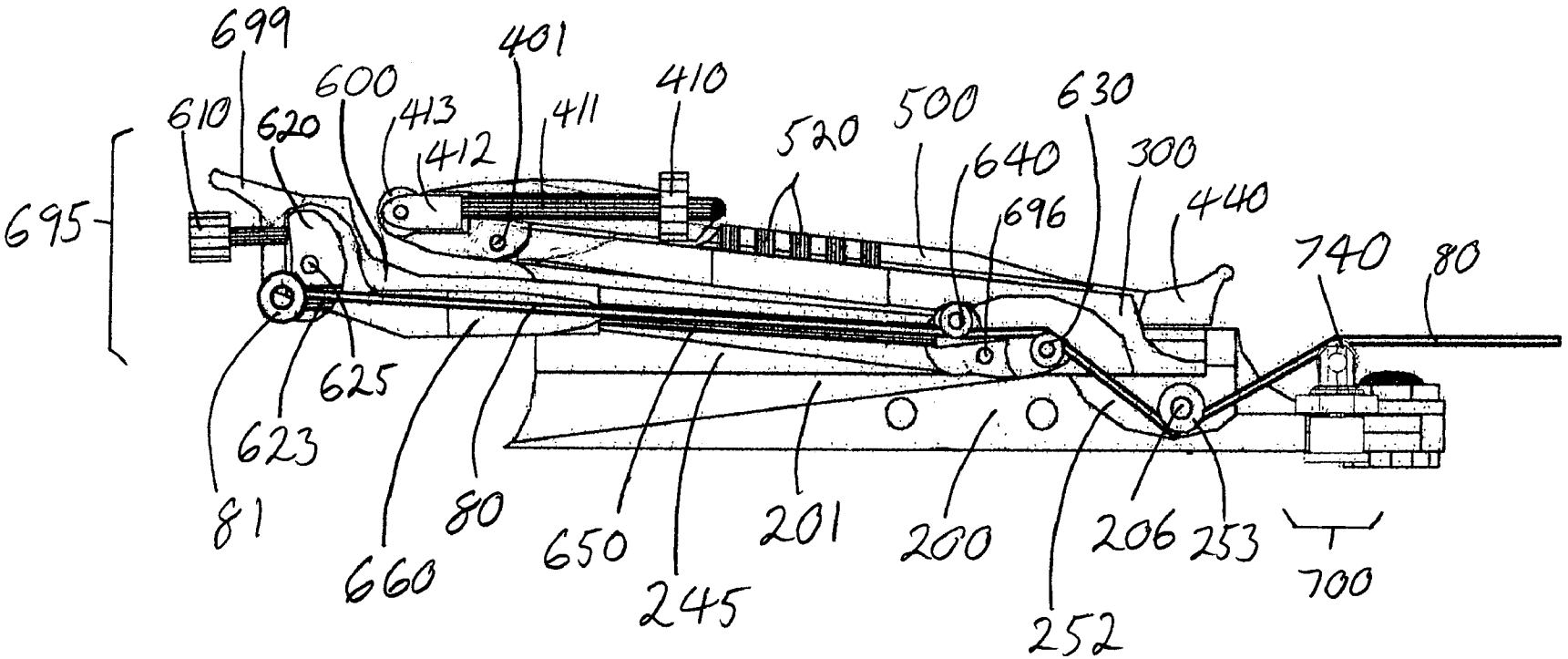
FIGS. 9*a* and 9*b* show cut-away side views of a machine according to the invention, taken along the Roman Numeral I of FIG. 8.
Figure 9B:
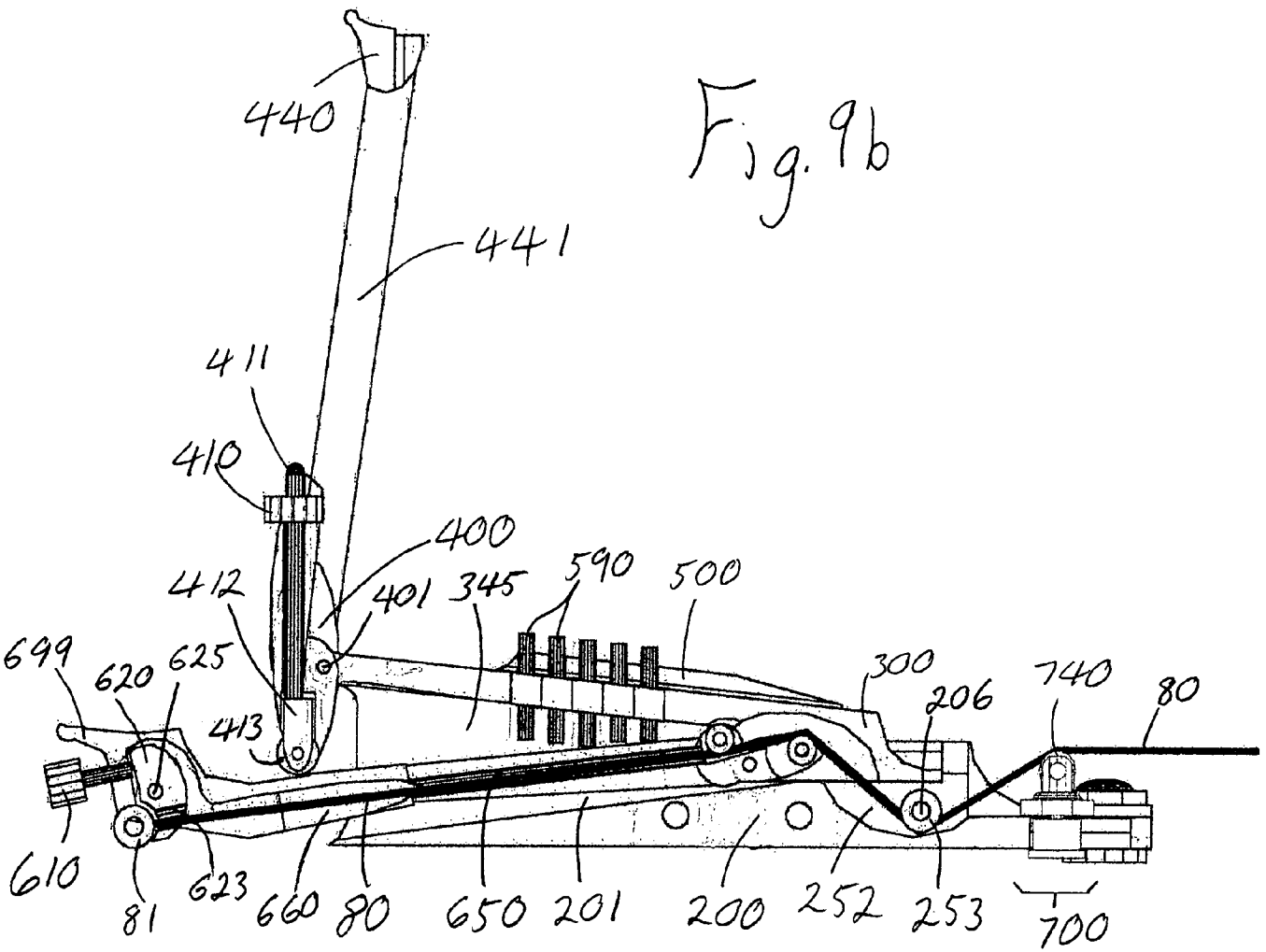
Figure 10A:
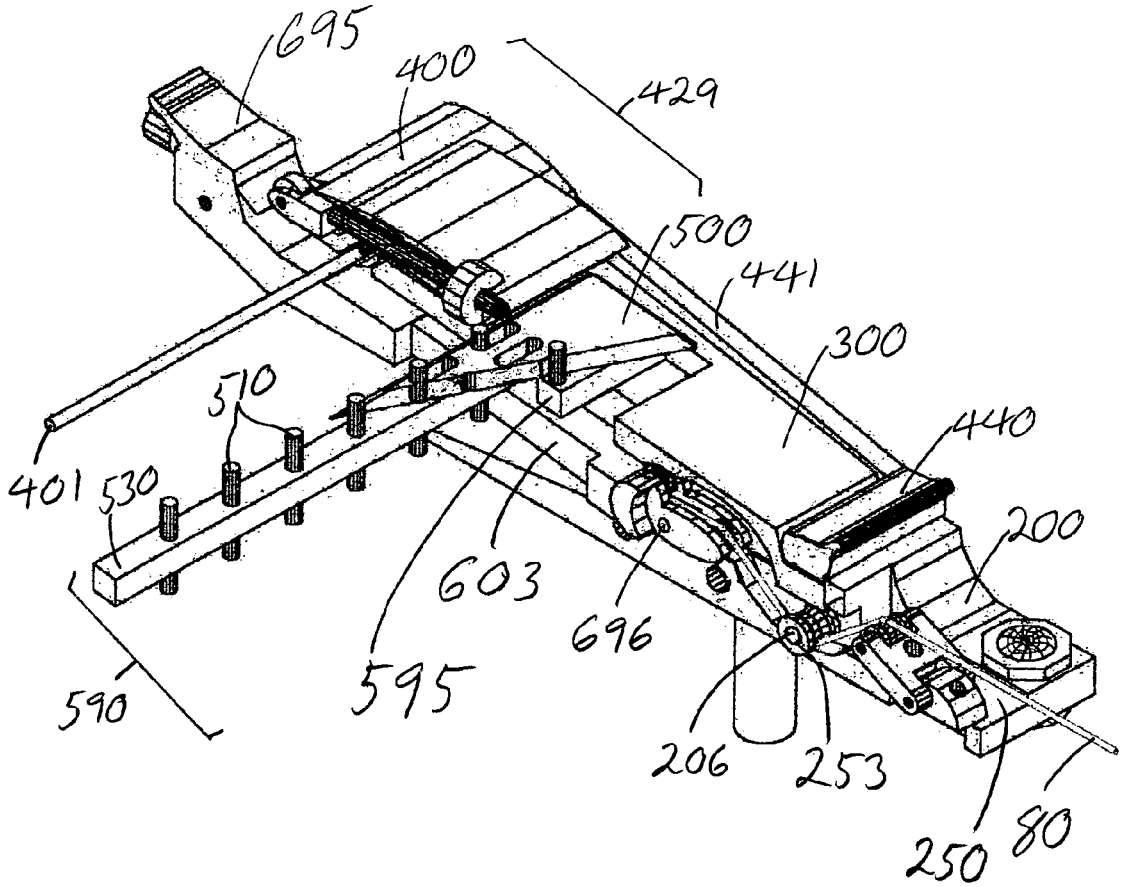
FIGS. 10*a* and 10*b* show a cut-away perspective view of a machine according to the invention.
Figure 10B:
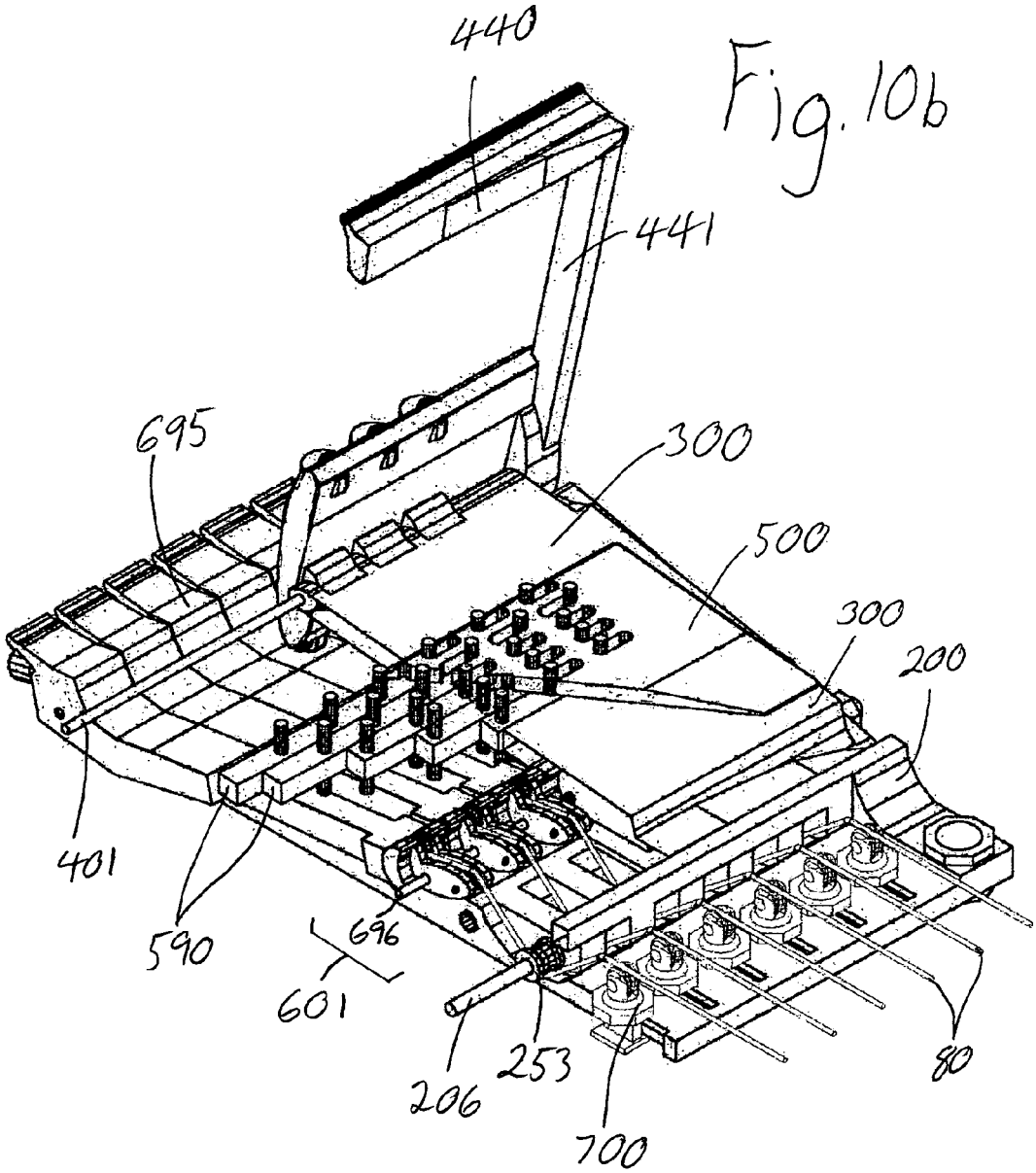

FIG. 4*a* shows a perspective view of the housing body 300, showing spaced-apart semicircular pivot structures 310, along the upper back portion of the housing body 300, defining apertures 311 therethrough, which engage lever body hinge 423 (shown in FIG. 5*b*), and, as engaged, accept the main pivot pin 401 (shown in FIG. 2), allowing the main pivot pin creating a hinge at lever body 400 and housing body 300 (shown in FIGS. 9*b* and 10*b*). Cut-out section 320 along each side of the housing body 300 accommodate lever arms 441, and a cut-out section 321 positioned transversely across the front section of the housing body 300 accommodates the lever handle 440, facilitating the repeated seating of the lever arms 441 and lever handle 440 into the housing body 300 while the invention is in use allowing the lever body 400 to be seated within the invention (best shown in FIGS. 9 and 10). A plurality of internal mechanisms such as the tuner switch screws 510 and tuner switch rods 530 (shown in FIG. 6*b*), which are supported on a plurality of ledges 340, are disposed within a tuner switch rod cut-out section 330, in the mid section of the housing body 300, and on opposite sides of the elongated centerline of the stringed musical instrument 21, facilitate tuner switch rod 530 movement transversely to and below the top plate 500 (shown in FIG. 10*a*). A plurality of housing body stop tailpiece bolt holes 355 are located in the mid-bottom section of the housing body 300. An upper control rod cut-out section 345 in the lower mid-to-rear section of the housing body 300 allows room for the control rod assemblies 695 to operate. A plurality of apertures are disposed vertically in the general outer perimeter of the housing body 300 so that the housing body mounting screw can secure the housing body 300 to the mounting base 200 (as shown in FIG. 10*a*). A threaded top plate aperture in the housing body 300 provides a means to secure the top plate 500 to the housing body 300 (as shown in FIG. 10*b*).

FIG. 4*b* shows a bottom perspective view of the housing body 300, showing the semicircular pivot structures 310, which define apertures 311 therethrough, which engage main pivot pin 401 (shown in FIG. 2), creating a hinge for lever body 400. A tuner switch rod cut-out portion 330 in the mid section of the housing body 300 provides room for the tuner switch rods 530 (as shown in FIG. 10*a*) to move in and out of tuning position. Further FIG. 4*b* show an upper control rod cut-out section 345, located in the lower back portion and extending forward through the lower mid section of the housing body 300. Said upper control rod cut-out section 345 is designed to let the control rod 600 (shown in FIG. 7*d*) function without leaving unnecessary space inside the housing body 300. A plurality of arc-shaped grooves 350 in the lower mid front section of the housing body 300 adjacent to the upper control rod cut-out section 345 that receive the control rod 600 control rod cantilever section 601 (also shown in FIG. 10*b*), facilitating the pivoting of the control rods 600 around the control rod pin 696. The plurality of arc-shaped grooves 350 correspond to the number of control rods 600, extend vertically from bottom of the housing body 300 across an aperture 325 and permit the pivoting of the control rod assembly 695. Moreover, a plurality of housing body stop tailpiece bolt holes 355 are located in the mid-bottom section of the housing body 300 on each side of the elongated centerline of the stringed musical instrument 21.

FIG. 5*a* shows a perspective view of the lever body 400 having a generally rectangular configuration with rounded edges, a plurality of lever arms 441 protruding forward from each side of the rear section of the lever body 400, to transfer energy from a lever handle 440 in the front section of the lever body 400 to the main pivot pin 401 in a aperture 402 (best seen in FIGS. 9 and 10), which is disposed though the lever body's 400 lower rear section. The housing body 300 pivot structure 310 (shown in FIGS. 4*a* and 4*b*) provides a hinge for the lever body 400 and said housing body 300. A plurality of grooves 420 are disposed in the upper back section of the lever body 400. Grooves 420 are large enough to facilitate the tuner extension adjustment bolt 411 mechanics (best seen in FIG. 7*a*) and are also disposed within a rectangular cut-out 421 in the furthermost rear section of the lever body 400 allowing the control block 412 to seat into the lever body 400. Further, cylindrical cut-out 422 is disposed along the horizontal path of said grooves 420 and is sufficiently hollowed to provide clearance for the tuner extension adjustment nut 410 to revolve around the horizontal elongated plane of the tuner extension adjustment bolt 411 while also retaining the tuner extension adjustment nut 410 from movement along the elongated centerline of the stringed musical instrument 21, thereby allowing the tuner extension adjustment nut 410 to facilitate the smooth movement of the tuner extension adjustment bolt 411 and control block 412 to provide a means for the tuner extensions 429 to operate (shown in FIG. 10*a*).

FIG. 5*b* shows a perspective bottom view of the lever body 400, showing a lever body hinge 423 located on the bottom rear section of the lever body 400. The lever body hinge 423 is generally arc-shaped and designed to join the lever body 400 and said housing body 300 at the pivot structure 310 to create a hinge in which the main pivot pin 401 (shown in FIG. 2), is disposed inside both a aperture 402, positioned transversely though the lever body 400 lower rear section, and the aperture 311, though the semi-circular pivot structure 310 (shown in FIGS. 4*a* and 4*b*), thereby allowing the lever body 400 to pivot vertically around the housing body 300 creating a cantilever hinge mechanism. A plurality of lever arms 441 protrude forward from each side of the rear section of the lever body 400 to the lever handle 440 in the front section of the lever body 400. A plurality of cylindrical cut-outs 422, and rectangular cut-outs 421 (best shown in FIG. 5*a*) facilitate the tuner extensions 429 (as seen in FIG. 2).

Figure 6A:
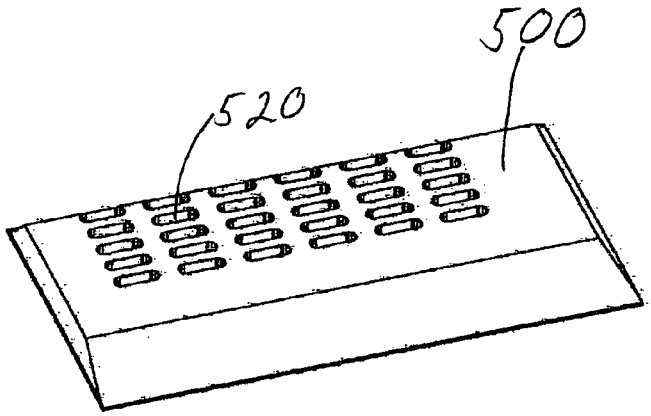
FIGS. 6*a*, 6*b*, and 6*c* show perspective views of a top plate, a tuner switch rod assembly and stop tail piece clamps, respectively, accordingly to the invention.
Figure 6B:
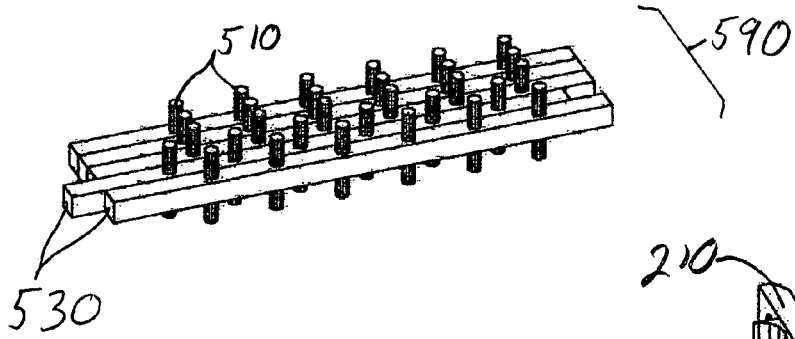
Figure 6C:
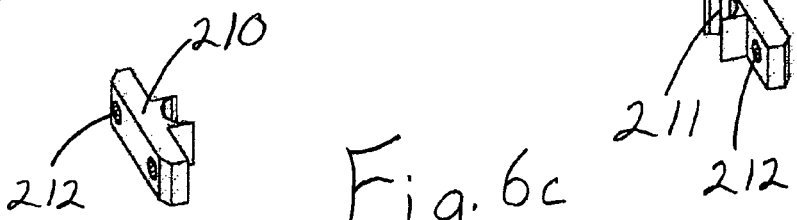

FIGS. 6*a*, 6*b*, and 6*c* show perspective views of the top plate 500, a tuner switch rod assembly 590, and a plurality of stop tail piece clamps 210. Said top plate 500 is of a generally rectangular configuration with a plurality of tuner switch screw slots 520 that give the tuner switch screws 510 room to move in and out of position. In this embodiment, the top plate 500 is separate from the housing body 300 to facilitate an easier understanding of the invention, although it may be incorporated into the housing body 300 as a single piece. The tuner switch rod assembly 590 would be located under the top plate 500 in the tuner switch rod cut-out section 330 (shown in FIGS. 4*a* and 4*b*). Each tuner switch rod 530 moves independently along a horizontal plane in a perpendicular direction to the elongated centerline of the stringed musical instrument 21 and has a plurality of tuner switch screws 510 that correlate to the number of strings 80 on the stringed musical instrument 21. Each tuner switch screw 510 penetrates a vertically threaded aperture through the tuner switch rod 530 to provide a means for adjusting the preset tuning of each tuner switch screw 510. The tuner switch rod cut-out section 330 is designed to hold the internal mechanical components of the tuner switch rod assembly 590 without leaving unnecessary space, thus facilitating the smooth movement between (in use, and not in use) for each tuner switch rod 530. Typically, there are two stop tail piece bolts 90 (as seen in FIG. 2); therefore, two stop tail piece clamps 210 would be used to secure the invention to the stringed musical instrument 21. Each stop tail piece clamp 210 has a plurality of horizontal apertures 212 that penetrate the stop tail piece clamp 210 on each side of a cylindrical cut-out section 211, located in the middle inward side of each stop tail piece clamp 210 and is designed to secure the invention to the stop tailpiece bolt 90.

FIG. 7*a* shows components of the tuner extensions feature 429 and is comprised of a rectangular-shaped control block 412 that has a roller bearing 413 inset on one end and retained by the control block pin 414 within aperture 415 through the control block 412 and a tuner extension adjustment bolt 411 extending forward from the opposite end of the control block 412. The tuner extension adjustment bolt 411 pierces the threaded aperture in the tuner extension adjustment nut 410. This assembly is to be encased within the lever body 400 (as shown in FIG. 10*a*).

FIG. 7*b* shows the bridge assembly 299, comprised of a bridge mount 220, with a mounting screw 221 penetrating both the vertical aperture 223 in the bridge mount 220 and a threaded aperture 224 in a wedge nut 222. Said wedge nut 222 is pulled into the rectangular slot 251 (shown in FIGS. 3*a* and 3*b*) by rotating said mounting screw 221 to provide a means for securing the bridge mount 220 firmly to the mounting base 200. A bridge arm 230, which is of a generally rectangular H-shaped configuration, is pinned to the bridge mount 220 via a lower bridge arm pin 241 that is inserted into both a lower bridge arm aperture 243 and a horizontal bridge mount aperture 245 at the bottom of the bridge arm 230 to form a hinge at the bridge arm 230 and the upper section of the bridge mount 220. Height adjustment of the strings can be obtained by turning a height adjustment screw 231 that rests on a height adjustment mount 234 rotating within a threaded vertical bridge arm aperture 232. A bridge roller 240 is counter sunk into the top of the bridge arm 230 and held in place by a upper bridge arm pin 242 and a bridge roller aperture 233, to provide the last point of contact for the string while allowing complete control of intonation and height as the string 80 slides and/or rolls during use of the invention.

FIG. 7*c* shows an exploded view of an alternate bridge assembly 700 (shown in FIGS. 8, 9*a*, 9*b*, and 10*b*) comprising an upside-down T-shaped retaining member 710 that has a threaded column 711 extending vertically from the general midsection of said retaining member 710. An alternate bridge roller 740 is counter sunk into the top of a roller support column 720 retained by a alternate bridge roller pin 725 within both a horizontal aperture 726 across a roller support column 720 and a alternate bridge roller aperture 727 to provide an adjustable last point of contact for the string, while allowing the string 80 to slide and/or roll. The externally threaded roller support column 720, with a threaded aperture 721 in the bottom, extends vertically through the center of the roller support column 720 for the threaded column 711 to screw into, allowing a support column lock nut 730 to pull up on the roller support column 720 and rest on the mounting base 200 (shown in FIG. 10*b*), which therefore pulls the threaded column 711 on the retaining member 710, securely clamping the alternate bridge assembly 700 to the mounting base 200, while allowing complete control of intonation and height.

Figure 7D:
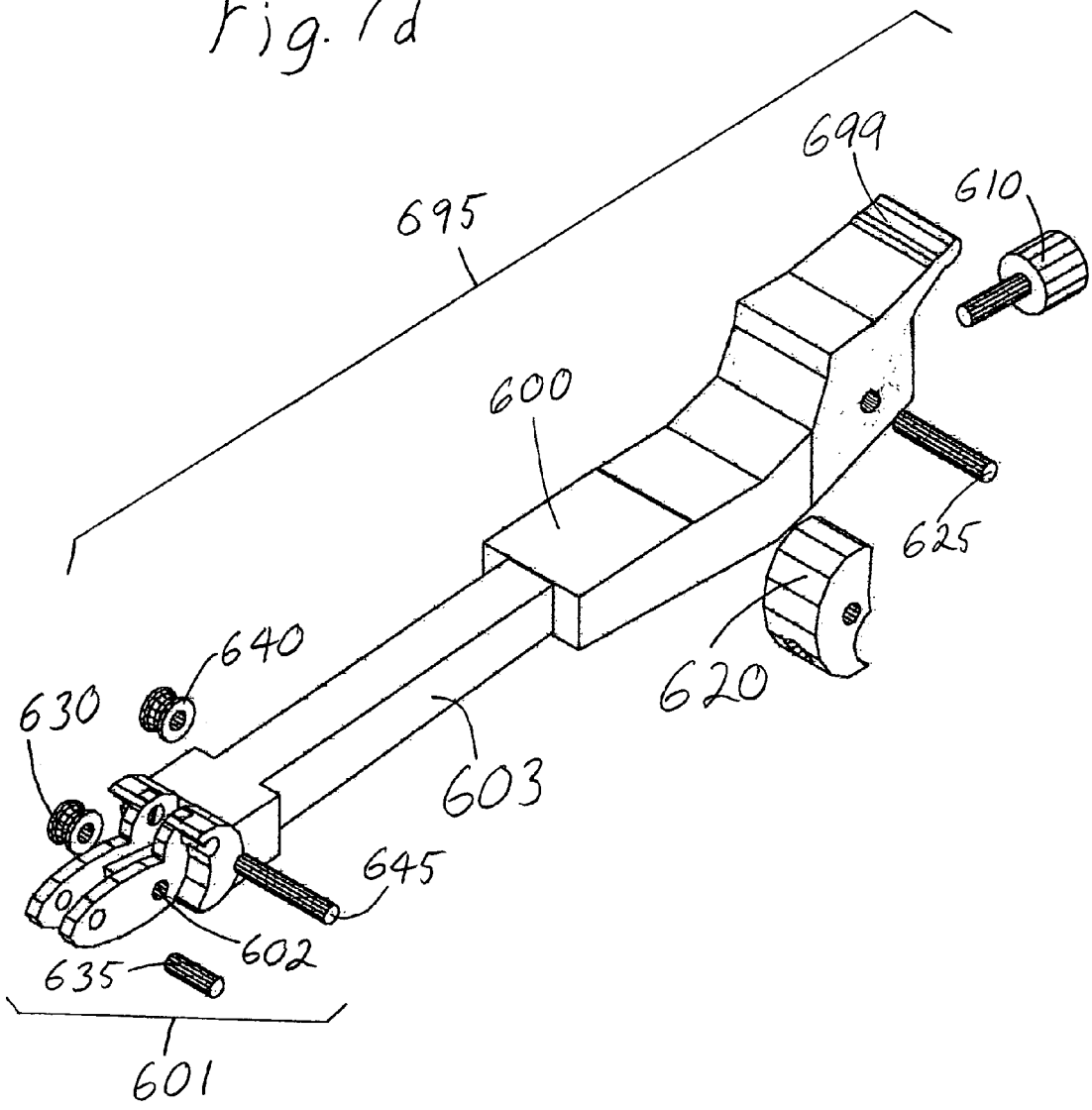

FIG. 7*d* shows an exploded view of the control rod assembly 695, which comprises a control rod body 600 having an elongated shape to facilitate the manipulation of string 80 tension by using leverage, and a knurled head bolt 610 to adjust a fine-tuning control lever 620 retained by a fine tuning control lever pin 625 in the general back section of the control rod body 600, under a control rod handle 699. Also FIG. 7*d* shows a control rod cantilever section 601 in the general front of the control rod body 600, with an aperture 602 placed at the general mid-point of the control rod cantilever section 601, and transversely to the elongated centerline of the control rod body 600, to provide a pivot point for the control rod cantilever section 601 of the control rod body 600. The control rod cantilever section 601 is comprised of a forward string roller 630, retained by a forward string roller pin 635 and an aft string roller 640, retained by a aft string roller pin 645, on each side of, and parallel to the aperture 602 in the control rod cantilever section 601. The forward string roller 630 is designed to bend the string 80 up while the aft string roller 640 is designed to bend the string 80 down, thereby, increasing the amount of force generated by the length of the control rod body 600. Further FIG. 7*d* shows a plurality of symmetrical cut-outs 603 located on each side of the midsection of the control rod body 600 to allow the tuner switch screws 510 (shown in FIG. 6*b*) room to function.

Figure 8:
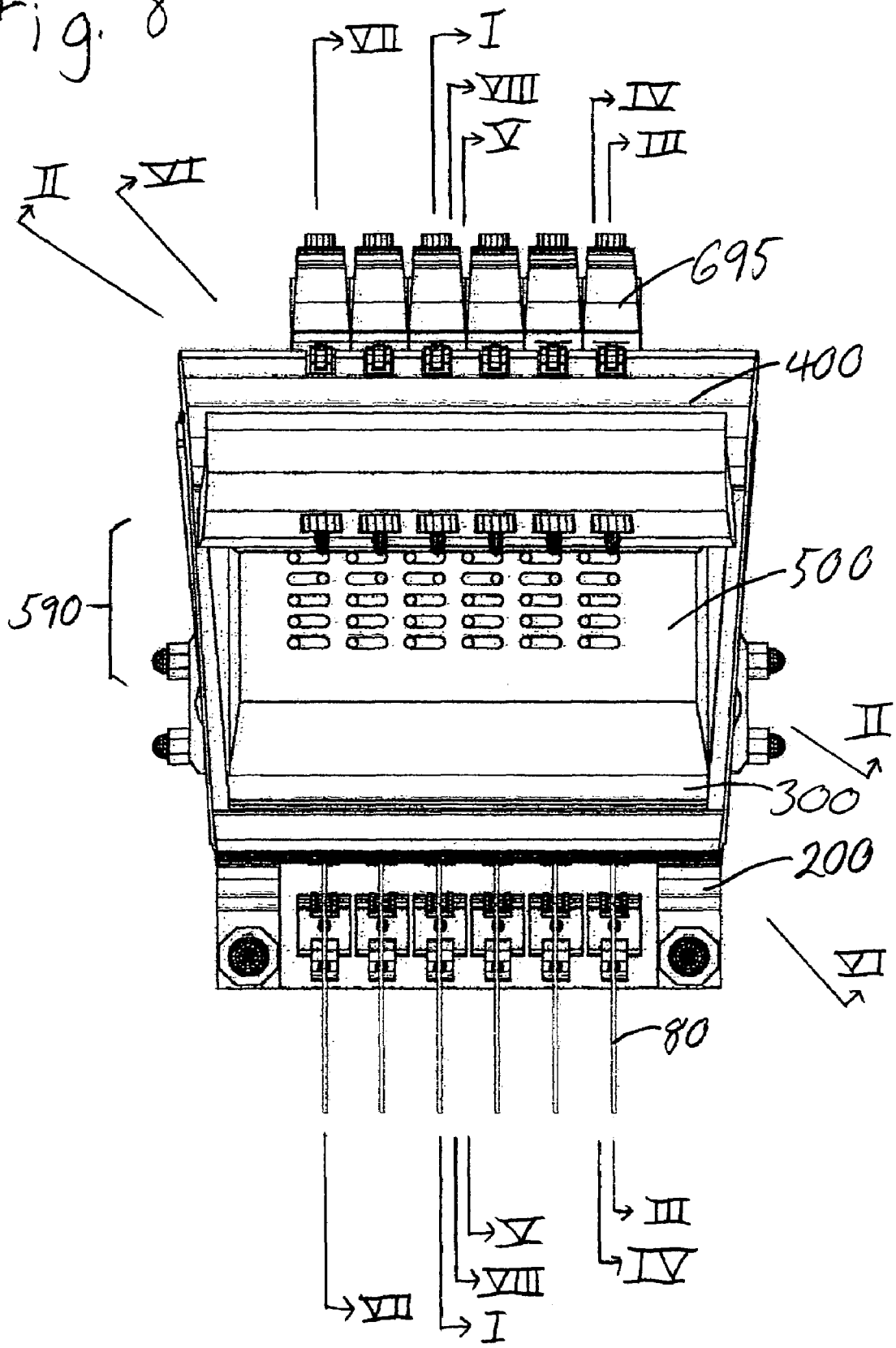
FIG. 8 shows a plan view of a machine according to the invention.

FIG. 8 shows a plan view of the fully assembled invention for the cut-away view layouts shown in FIGS. 9 and 10 illustrating the cut-away path of each component and showing the relation of each component within the invention. Roman Numeral I shows the cross-section path in the mounting base 200, housing body 300, lever body 400, and the control rod assembly 695, to illustrate how the string 80 is manipulated in FIG. 9; Roman Numeral II shows the cut-away path in the top plate 500, illustrating the relation between tuner switch rod assembly 590 and control rod assemblies 695; Roman Numeral III shows a cut-away path in the mounting base 200, housing body 300, and lever body 400 to allow for the viewing of the internal components within the invention; Roman Numeral IV shows a cut-out in one tuner switch rod 530 further described in FIG. 10*a*. In FIG. 10*b*, Roman Numeral V represents the cut-away in the lever body 400; Roman Numeral VI is the cut-away in top plate 500; Roman Numeral VII represents the cut-away in mounting base 200; Roman Numeral VIII is the cut-away in housing body 300.

FIGS. 9*a* and 9*b* show a cross-section path through the invention of an embodiment of FIG. 8, taken along the cut line I-I (Roman Numeral I), showing the relation of the control rod assembly 695 to the guitar string 80. Said control rod assembly 695 comprises a control rod body 600, which houses a knurled head bolt 610 and a fine tuning control lever 620, that is held in place and pivots on the fine tuning control lever pin 625, which is covered by a control rod handle 699. The guitar string 80 passes through an aperture 623, parallel to the elongated centerline of the stringed musical instrument 21, in the bottom portion of the fine tuning control lever 620. The guitar string 80 held in place by a guitar string stop 81 located at one end of each guitar string 80. The guitar string then passes through an aft string void 660 and a forward string void 650 until it comes in contact with the bottom portion of the aft string roller 640. The string then passes over the forward string roller 630, under the bottom string roller 253 located in the general mid-section of the mounting base 200, and over the alternate bridge roller 740, which is the last contact point for the guitar string 80 and is located within the alternate bridge assembly 700. The control rod assembly 695 is held in place by the control rod pin 696, which is located in the general mid-section of housing body 300, and allows for the movement of the control rod cantilever section 601 (shown in FIG. 7*d*), thus forming a fulcrum point for the control rod assembly 695 at said control rod pin 696. When the lever handle 440 is pulled upward and away from the housing body 300 (as shown in FIG. 9*b*) it transfers energy through the lever arms 441 and lever body 400 to the main pivot pin 401. As the lever body 400 pivots on the main pivot pin 401, it then transfers the energy through the tuner extension adjustment nut 410 which holds the tuner extension adjustment bolt 411 and the control block 412 within the lever body 400. The control block 412 retains a roller bearing 413, which allows for smoother movement across the control rod body 600 as the lever body 400 pivots. The upper control rod cut-out section 345 and lower control rod component cut-out 201 allow the control rod assembly 695 the room to move freely within the confines of the invention, while pivoting on the control rod pin 696. This applies force to the guitar strings 80 while also allowing them to slide and/or roll via the forward string rollers 630 and the aft string rollers 640. The bottom string roller pin 206 retains the bottom string rollers 253 inside each bottom string rollers cavity 252 within the mounting base 200, giving the guitar string 80 a stationary angle before reaching the alternate bridge roller 740, which is the last contact point for the guitar string 80 before it is stretched across the guitar neck 23. FIG. 9*a* shows the tuner switch screw slots 520 in the top plate 500 with the tuner switch rod assembly 590 removed to reveal a better view of the control rod assembly 695. But in FIG. 9*b*, the tuner switch rod assembly 590 is shown to show the relation of tuner switch rod assembly 590 and control rod assembly 695 when the lever handle 440 is in the raised position.

FIG. 10*a* and 10*b* show perspective cut-away views of the invention. FIG. 10*a* shows a cut away path taken along the cut line II-II in FIG. 8, in the top plate 500, revealing a cutaway tuner switch rod assembly 595, taken along the cut line IV-IV. This shows how one tuner switch rod assembly 590 can rest beside the control rod assemblies 695 and how one selected tuner switch rod assembly 590 holds the control rod assemblies 695 in position. The tuner switch screws 510 screw into the tuner switch rods 530, therefore turning the tuner switch screws 510 in one direction or the other will lower or raise the control rod assemblies 695 that are held in place by that selected tuner switch rod assembly 590. The other tuner switch screws 510 that are in the non-selected tuner switch rod assemblies 590 rest beside the symmetrical cut-outs 603 located on each side of the midsection of the control rod body 600. A separate cut away path, taken along cut line III-III in FIG. 10*a*, shows the mounting base 200, housing body 300 and lever body 400, all cutaway along the same line so as to show the relationship between the tuner switch rod assemblies 590 and the control rod assemblies 695. Further, the housing body mounting screws 306 (not shown) are designed to securely affix the housing body 300 to the mounting base 200. When the lever handle 440 is raised (as shown in FIG. 10*b*) the energy is transferred through the lever arms 441 to the lever body 400, pivoting on the main pivot pin 401 and pushing the control rod assemblies 695 downward, in turn pivoting on the control rod cantilever section 601, thereby increasing tension on the guitar strings 80. This tension is transferred along the guitar strings 80 across the bottom string rollers 253 which are held in place by the bottom string roller pin 206 to the alternate bridge assemblies 700 that are located in the rectangular bridge cut-out section 250. The bottom string rollers 250 that are incorporated into the invention allow the tension within the guitar strings 80 to be manipulated freely across the length of the guitar string 80 without having to worry about sudden slippage. FIG. 10*b* also shows a cut-away path, taken along the cut line V-V in FIG. 8, in the lever body 400 to better show the relation between the control rod assemblies 695 and lever body 400. FIG. 10*b* also shows a cut-away path, taken along the cut line VI-VI in the top plate 500, which permits viewing of the tuner switch rods 530, a cut-away path, taken along the cut line VII-VII, in the mounting base 200, a cut-away path, taken along cut lines VIII-VIII, in the housing body 300, to help show the control rod pin 696, which is located in the general mid-section of housing body 300 and the relation of lever body 400 and control rod assemblies 695. Further, FIG. 10*b* shows a plurality of top plate screws 506 designed to securely affix said top plate 500 to the housing body 300.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. A machine for changing the key of a stringed musical instrument comprising:

a quadrilateral shaped mounting base with a means for more securely affixing said mounting base to the general front mid-section of a stringed musical instrument;

a generally rectangular shaped housing body that is secured to the top of said mounting base;

a plural of elongated control rod assemblies that extend through said housing body and said mounting base;

a plural of tuner switch rod assemblies that provide a means for switching between present tunings;

a top plate that is attached to the general top center of said housing body to provide a means of retaining said tuner switch rod assemblies;

a lever body having a generally rectangular configuration with rounded edges, and a plural of lever arms protruding forward from each side of the rear section of said lever body to a lever handle;

a plural of tuner extension features that extend the tuning capabilities of the invention that are located in the rear of said body;

a plural of bridge assemblies located in the general front section of the invention that provide an adjustable last contact point for the strings, and corresponding to the number of strings on the stringed musical instrument; and a plural of alternate bridge assemblies that are designed to allow string height and intonation adjustment and may be used instead of said bridge assemblies.

2. A machine for changing the key of a stringed musical instrument as described in claim 1 further comprising:

a mounting base with a plural of stop tailpiece clamps that secure the invention to the stringed musical instrument;

a plural of semicircular indentations on each side of said mounting base that receive the preexisting stop tail piece bolts, and allow said stop tail piece clamps to secure the invention to the stringed musical instrument; and a plural of apertures through said mounting base and each stop tail piece clamp that allow a plural of nuts and bolts to securely affix the invention to the stop tail piece bolts.

3. A machine for changing the key of a stringed musical instrument as described in claim 2 further comprising:

a plural of vertical apertures which extend through the outer front sections of said mounting base and on opposite sides of the elongated centerline of the stringed musical instrument, to further facilitate the mounting of the invention; and a plural of bridge nuts that screw onto the bridge post that previously existed on the stringed musical instrument to further secure the invention.

4. A machine for changing the key of a stringed musical instrument as described in claim 2 further comprising:

a rectangular bridge resection located at the front of said mounting base to facilitate the mounting of said bridge assemblies and alternate bridge assemblies; and a plural of rectangular slots within said rectangular bridge resection that facilitates the locking of said bridge assemblies or alternate bridge assemblies on a parallel plain to the instruments strings.

5. A machine for changing the key of a stringed musical instrument as described in claim 2 further comprising:

a plural of bottom string roller cavities corresponding to the number of strings on the instrument, adjacent and extending in a downward arc from the middle back section of said rectangular bridge resection, for the strings to pass through from said control rod body to said bridge assembly or said alternate bridge assembly; and a plural of bottom string rollers located within said bottom string roller cavities to allow the strings to stress from the internal mechanics of the invention.

6. A machine for changing the key of stringed musical instrument as described in claim 2 further comprised of a large angled lower control rod component cavity located in the center back portion of said mounting base to facilitate the internal mechanical components of the present invention.

7. A machine for changing the key of a stringed musical instrument as described in claim 1 further comprising:

a generally rectangular shaped housing body with a upper control rod component cavity that allows the internal mechanical components to move freely within the invention; and a tuner switch rod component cavity of a generally rectangular configuration located in the mid-section and countersinking into said housing body from the top downward to provide room for said tuner switch rods.

8. A machine for changing the key of a stringed musical instrument as described in claim 7 further comprising:

a semicircular pivot structure along the upper back portion of said housing body to provide a means for mounting said lever body;

a quantum of rectangular shaped extirpations along said semicircular pivot structure that allow said lever body described in claim 1 to interlock with said housing body; and an aperture positioned transversely through said semicircular pivot structure for a main pivot pin, which will attach said lever body to said housing body creating a fulcrum point to manipulate said control rod assemblies.

9. A machine for changing the key of a stringed musical instrument as described in claim 7 further comprising a plural of resections along each side, and in front of said housing body, for the repeated countersinking of said lever body into said housing body, allowing said lever body's size to be diminished within the invention.

10. A machine for changing the key of a stringed musical instrument as described in claim 7 further comprising:

a plural of arc shaped extirpations extending vertically from the bottom of said housing body and is sufficiently hollow to permit the fulcrum of said control rod cantilever section; and an aperture transpiercing the lower front mid-section of said housing body through said arc shaped extirpations for said control rod pin to create a fulcrum point for said control rod cantilever section.

11. A machine for changing the key of a stringed musical instrument as described in claim 1 further comprising:

a control rod assembly, which has a control rod body of a generally rectangular, elongated shape to facilitate the manipulation of string tension by using leverage;

a fine tuning control lever retained by a fine tuning control lever pin in the general back section of each control rod body, under a control rod handle;

a knurled head bolt to adjust said fine-tuning control lever in the back section of said control rod body.

12. A machine for changing the key of a stringed musical instrument as described in claim 11 further comprising:

an aperture in the mid-section of said control rod cantilever section on said control rod body to provide a pivot point for said control rod assembly;

a forward string roller and an aft string roller that are positioned on opposite sides of said aperture in said control rod cantilever section.

13. A machine for changing the key of a stringed musical instrument as described in claim 11 further comprised of a plural of symmetrical resections located on each side of the mid-section of said control rod body to allow said tuner switch rod assembly room to switch from in use to not in use.

14. A machine for changing the key of a stringed musical instrument as described in claim 7, further comprising:

a plurality of tuner switch rod assemblies each having a tuner switch rod which moves independently along a horizontal plane in a direction perpendicular to the elongated centerline of the stringed musical instrument, where said tuner switch rod assemblies rest in the tuner switch rod component cavity, whereby the tuner switch rod component cavity facilitates the smooth movement of the tuner switch rod assemblies between in use and not in use settings for each tuner switch rod assembly;

a plurality of tuner switch screws that correlate to the number of stings on the stringed musical instrument, where each of said plurality of tuner switch screws penetrate a vertically threaded aperture through each said tuner switch rod to provide a means for adjusting the preset tuning of each control rod assembly.

15. A machine for changing the key of a stringed musical instrument as described in claim 1 further comprised of a top plate that is of a generally rectangular configuration with a plural of tuner switch screw resections that give said tuner switch screws room to move in and out of position.

16. A machine for changing the key of a stringed musical instrument as described in claim 1 further comprising:

a tuner extension feature that has a tuner extension adjustment nut with a threaded aperture through the middle section;

a tuner extension adjustment bolt that pierces said threaded aperture in said tuner extension adjustment nut to allow for adjustment of said tuner extension feature;

a roller bearing inset on one end of a rectangular shaped control block affix to one end of said tuner extension adjustment bolt to facilitate a smoother movement while manipulating said lever body.

17. A machine for changing the key of a stringed musical instrument as described in claim 1 further comprising:

a lever body with a generally rectangular configuration having rounded edges and a plural of lever arms protruding forward from each side of said lever body;

a lever handle located in the front section of said lever arms protruding forward from each side of said lever body, thus facilitating the transfer of energy from a lever handle to a main pivot pin.

18. A machine for changing the key of a stringed musical instrument as described in claim 17 further comprising:

an aperture in the upper back section of said lever body that is parallel to the elongated centerline of the stringed musical instrument and is large enough to facilitate said tuner extension adjustment bolt's mechanics;

a rectangular resection in the furthermost rear section of said lever body allowing said control block to countersink into said lever body; and a cylindrical resection located along the horizontal path of said aperture in the upper back section of said lever body, and is sufficiently hollowed to provide clearance for said tuner extension adjustment nut to revolve around the horizontal elongated plane of said tuner extension adjustment bolt while also retaining said tuner extension adjustment nut from movement along the elongated centerline of the stringed musical instrument.

19. A machine for changing the key of a stringed musical instrument as described in claim 17 further comprising:

an aperture positioned transversely through said lever body's lower rear section for a main pivot pin that allows said lever body to pivot vertically around said housing body creating a cantilever mechanism that manipulates said control rod assembly;

a lever body hinge that is of a generally arc shaped design to facilitate the fulcrum of said lever body and said housing body.

20. A machine for changing the key of a stringed musical instrument as described in claim 1 further comprising:

a bridge assembly with a bridge roller that is counter sank into the top of a bridge arm that is of a generally rectangular H-shaped configuration and provides the last point of contact for the string, while all owing complete control of intonation and height as the string stresses from the use of the internal mechanics of the invention;

a height adjustment screw that can be rotated within a threaded vertical bridge arm aperture allowing for string height adjustment;

a bridge mount that is of a generally arc shaped configuration and designed to affix said bridge arm to the invention while allowing for string height adjustment;

a wedge nut with a mounting screw penetrating both a vertical aperture in said bridge mount, and a threaded aperture in said wedge nut, allowing for the adjustment of string intonation while securely affixing said bridge assembly to said mounting base.

21. A machine for changing the key of a stringed musical instrument as described in claim 1 further comprising:

an alternate bridge assembly with an alternate bridge roller that allows the string to stress from the internal mechanics of the invention;

an externally threaded roller support column that supports said alternate bridge roller while allowing the string to stress from the internal mechanics of the invention;

an upside-down T-shaped retaining member, that has a threaded column extending vertically from the general mid-top section of said retaining member;

a support column lock nut that secures said roller support column to said mounting base by pulling up on said roller support column that is screwed onto said threaded column extending vertically from the general mid-top section of said retaining member.

* * * * *